US009233048B2

(12) United States Patent
Wu

(10) Patent No.: US 9,233,048 B2
(45) Date of Patent: Jan. 12, 2016

(54) WATERPROOF HAND-HELD ELECTRIC BREAST MASSAGER

(71) Applicant: Dong-Her Wu, Chang-Hua Hsien (TW)

(72) Inventor: Dong-Her Wu, Chang-Hua Hsien (TW)

( * ) Notice: Subject to any disclaimer, the term of this patent is extended or adjusted under 35 U.S.C. 154(b) by 670 days.

(21) Appl. No.: 13/633,868

(22) Filed: Oct. 2, 2012

(65) Prior Publication Data

US 2014/0094722 A1 Apr. 3, 2014

(51) Int. Cl.
*A61H 23/02* (2006.01)

(52) U.S. Cl.
CPC .... *A61H 23/0263* (2013.01); *A61H 2201/0111* (2013.01); *A61H 2201/0153* (2013.01); *A61H 2201/1619* (2013.01); *A61H 2201/1635* (2013.01); *A61H 2205/082* (2013.01)

(58) Field of Classification Search
CPC ..... A61H 7/00–7/005; A61H 9/00–9/0007; A61H 9/005–9/0057; A61H 23/00–23/04; A61H 33/00; A61H 37/00; A61H 39/00–39/04; A61H 2009/00; A61H 2009/0064; A61H 2201/12–2201/1246; A61H 2205/082; A61H 1/06–1/08
See application file for complete search history.

(56) References Cited

U.S. PATENT DOCUMENTS

| | | | | |
|---|---|---|---|---|
| 4,697,580 | A * | 10/1987 | Terauchi | 601/71 |
| 6,432,071 | B1 * | 8/2002 | Hsieh | 601/72 |
| 8,545,390 | B2 * | 10/2013 | Talbot et al. | 600/38 |
| 2005/0267386 | A1 * | 12/2005 | Copelan | 601/14 |
| 2010/0312156 | A1 * | 12/2010 | Wu | 601/112 |

* cited by examiner

*Primary Examiner* — Rachel Young

(57) ABSTRACT

A waterproof hand-held electric breast massager includes a casing, a driving motor, a power supply element and a massaging member. The sealing cover is disposed at one end of the tubal body and at least one a protrusion at another end of the tubal body. The bottom body further has a conductive sheet, and at least one a positioning slot around a hollow portion of the bottom body. When the positioning slot of the bottom body is aligned with the protrusion, the bottom body can be inserted into the tubal body. The driving motor is mounted in the tubal body, and the driving motor has a first and a second conductive parts. The first conductive part and the conductive sheet make contact with each other. The massaging member has a bowl-like shape and a lip with an elastic curved surface at a circumference edge such that the casing is disposed perpendicular with the lip of the massaging member.

7 Claims, 8 Drawing Sheets

WATERPROOF HAND-HELD ELECTRIC BREAST MASSAGER

BACKGROUND OF THE INVENTION

1. Field of the Invention

The present invention relates to a breast massager, and more particularly to a waterproof hand-held electric breast massager.

2. Description of the Related Art

Traditional beauty standards frequently consider that the breast area of a woman should have certain proportions. As a result, breast size is often an important issue for many women. Some women may use drugs or the like in an attempt to enhance breast size. Others may employ an enhancing device for the same purpose. A benefit of the later is that such devices are less harmful to the health of the individual.

Many breast enhancing devices employ suction; others may employ a massaging device. The suction-based devices require a vacuum system to provide the pulling force around the breast area that stimulates the breast tissue. However, such devices are frequently bulky, heavy and relatively complicated in structure. With respect to the massaging devices, such devices require an electric motor with a biased shaft or an eccentric weight to generate vibration or a shaking effect that is imparted onto the breast region to stimulate the breast tissue. However, such devices typically require a power cord or batteries, neither of which is ideal for use in wet conditions due to the risk of electrical shorts.

Therefore, it is desirable to provide a waterproof hand-held electric breast massager to mitigate and/or obviate the aforementioned problems.

SUMMARY OF THE INVENTION

An objective of the present invention is to provide a waterproof hand-held electric breast massager.

In order to achieve the above mentioned objective, a waterproof hand-held electric breast massager includes a casing, a driving motor, a power supply element and a massaging member. The casing with a tubal shape has a sealing cover, a tubal body and a bottom body. The sealing cover has a sealing rim at one end and the sealing rim is completely separated from one end of the tubal body. An indentation portion is provided at another end of the sealing cover. One end of the tubal body is adjacent to the sealing cover provided with a containment space and a controller is provided at another end, and a stepped region is formed between the containment space and the controller. The controller has at least one protrusion at an inner wall. The bottom body has a hollow portion and a conductive sheet extending from the hollow portion towards to an open end. The bottom body has at least one positioning slot corresponding to the protrusion at an outer wall of the open end of the hollow portion. The tubal body has a circular slot at one side of the positioning slot and a sealing washer provided in the circular slot, such that the sealing washer is sandwiched between the tubal body and the bottom body. The driving motor is mounted in the containment space of the tubal body and securely sandwiched by the sealing cover and the stepped region of the tubal body, and the driving motor is provided with a rotating shaft disposed in the sealing rim and combined with an eccentric block. The driving motor is further provided with a first conductive part and a second conductive part formed towards to the controller, and the first conductive part of the driving motor is capable of making contact with the conductive sheet of the bottom body. The power supply element is mounted in the hollow portion of the bottom body, the power supply element is provided with a first electrode and a second electrode. The first electrode makes contact with the second conductive part of the driving motor, and the second electrode makes contact with the conductive sheet of the bottom body. The massaging member has a bowl-like shape and a lip with an elastic curved surface at a circumference edge, and a connecting portion is provided at an end of the massaging member and disposed in the indentation portion of the sealing cover such that the casing is disposed perpendicular with the lip of the massaging member.

A main characteristic of the embodiment of the present invention is water-proof effect. The water-proof effect is provided between the sealing cover and the tubal body by adhesive or high-frequency induction hardening process. Furthermore, the circular slot of the bottom body is provided with the sealing washer, and the tubal body and the bottom body sandwich the sealing washer in between for a water sealing effect. Therefore, the casing is capable of completely seal-in the driving motor and the power supply element, which is very convenient for the user to use the massager in the shower or the bathtub without short circuit problem.

Another characteristic of the embodiment of the present invention is, the casing has a long rod shape, and the casing is disposed perpendicular with the lip of the massaging member. The casing is designed in a regular hand-held size and capable of accepting the driving motor and the power supply element, and the massaging member is mounted in the sealing cover of the casing for providing vibration.

Another characteristic of the embodiment of the present invention is water-proof effect. The water-proof effect is provided between the sealing cover and the tubal body by adhesive or high-frequency induction hardening process. Furthermore, the circular slot of the bottom body is provided with the sealing washer, and the tubal body and the bottom body sandwich the sealing washer in between for a water sealing effect. Therefore, the casing is capable of completely seal-in the driving motor and the power supply element, which is very convenient for the user to use the massager in the shower or the bathtub without short circuit problems.

Another characteristic of the embodiment of the present invention is, the protrusion is correspondingly moved to the ON corresponding slot of the positioning slot, and the engagement between the protrusion and the positioning slot provides positioning effect to the driving motor. The engagement between the protrusion of the tubal body and the positioning slot of the bottom body provides connection and positioning, and the control panel provides status indication.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
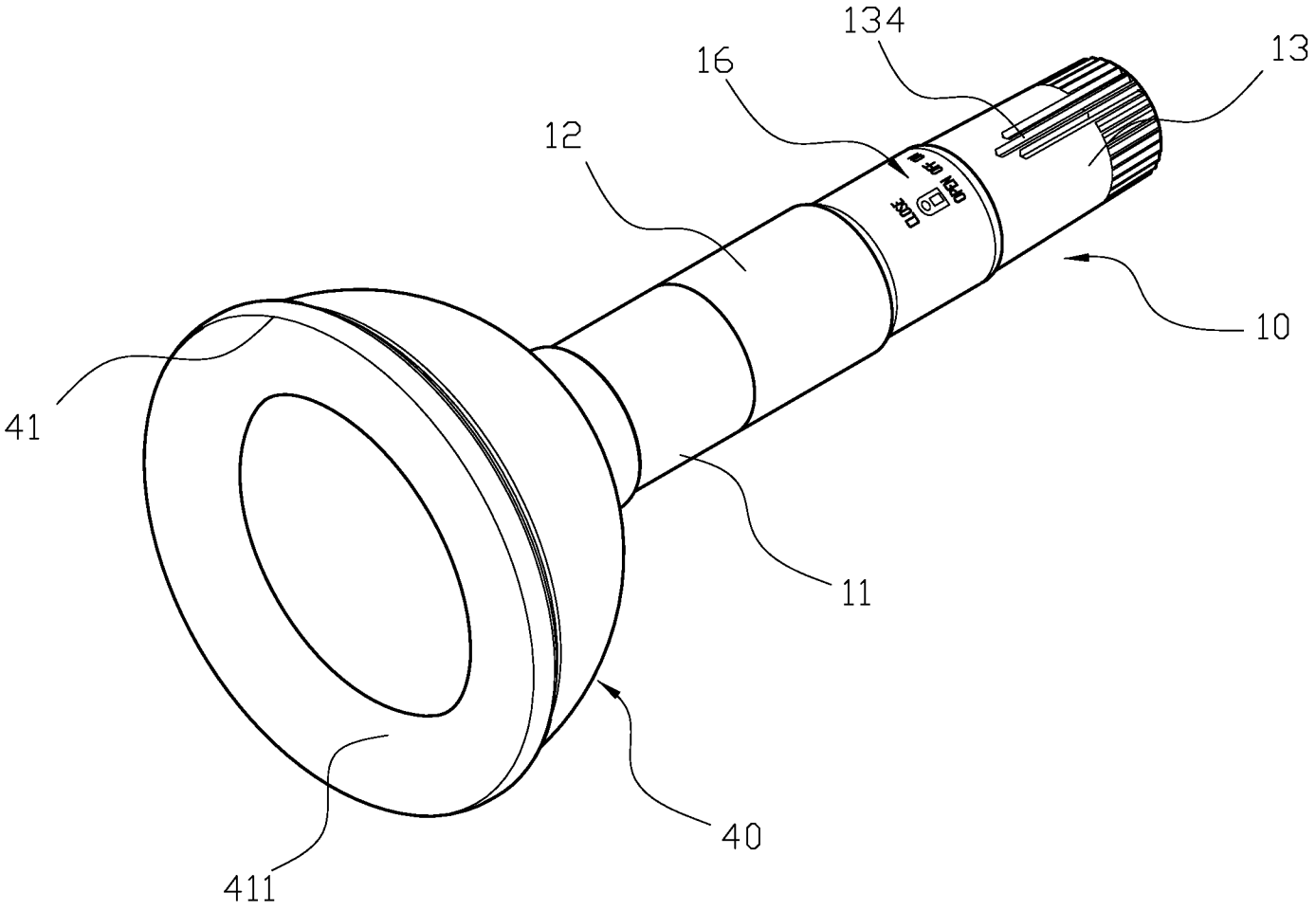
FIG. 1 is a perspective view of an embodiment of the present invention.
Figure 2:
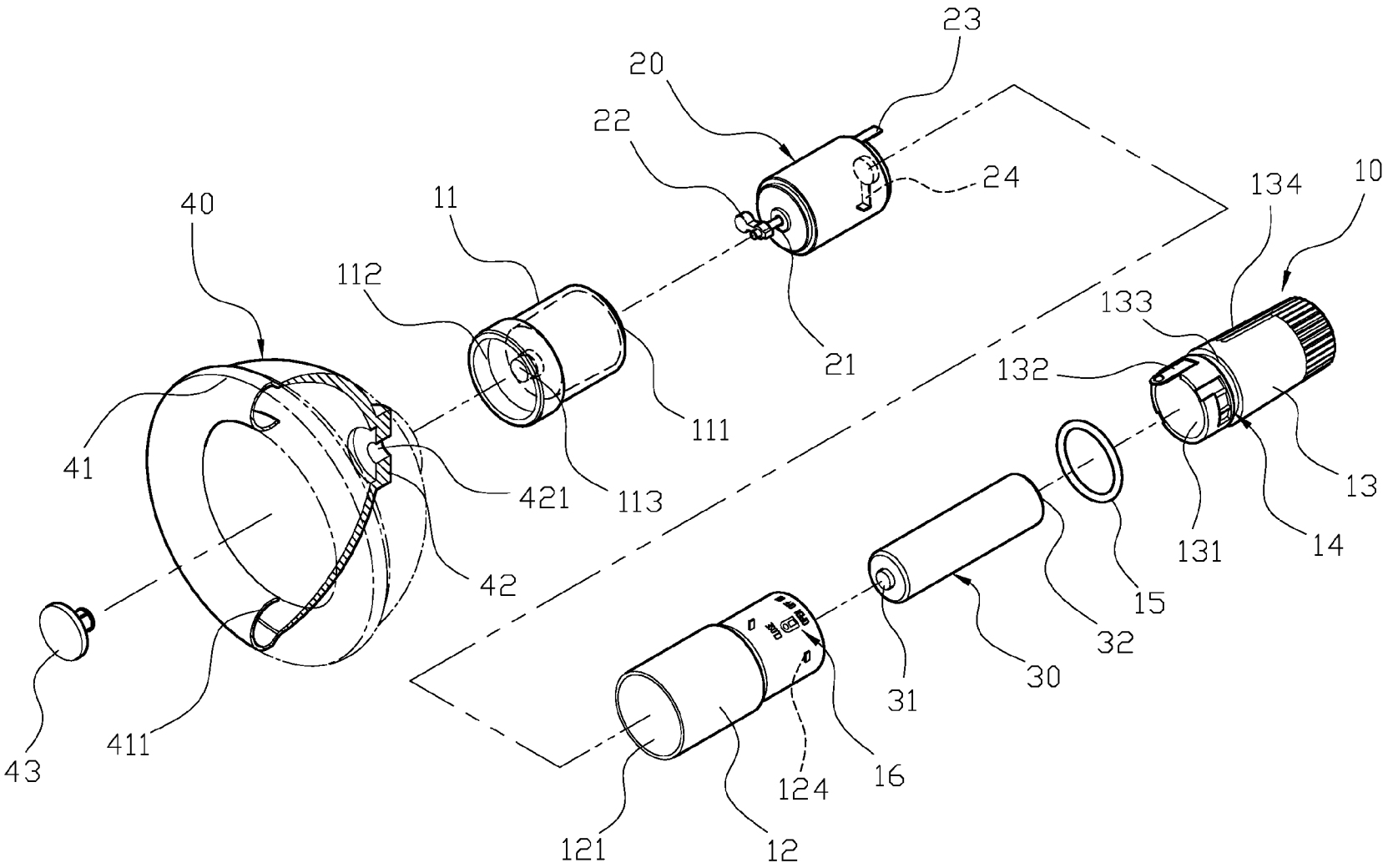
FIG. 2 is an exploded drawing of the embodiment of the present invention.
Figure 3:
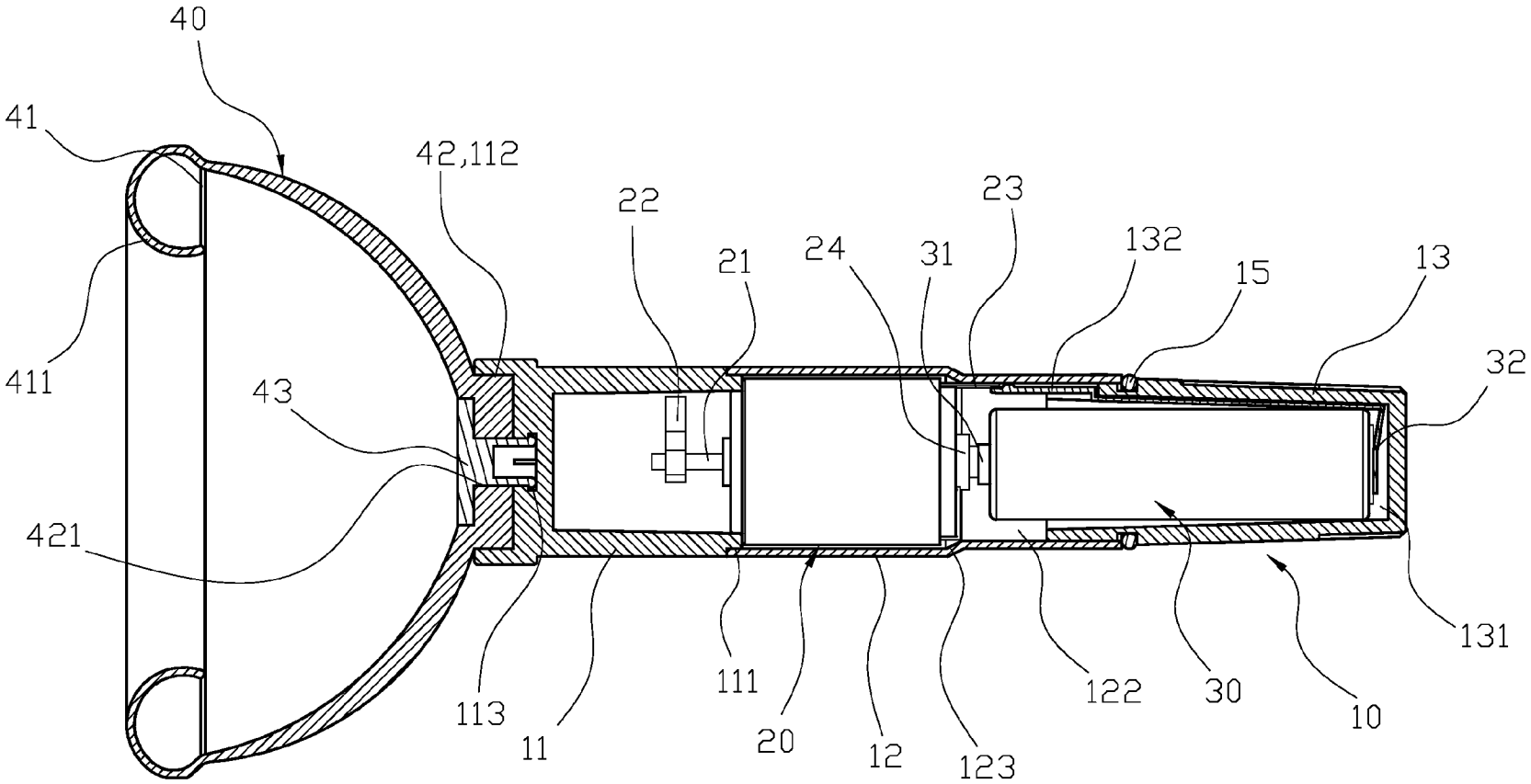
FIG. 3 is a cross-sectional drawing of the embodiment of the present invention.

Please refer to FIG. 1, FIG. 2 and FIG. 3. A waterproof hand-held electric breast massager comprises a casing 10, a driving motor 20, a power supply element 30 and a massaging member 40. The casing 10 is in a tubal shape and has a sealing cover 11, a tubal body 12 and a bottom body 13. The sealing cover 11 has a sealing rim 111 at one end, the sealing rim 111 is completely separated from one end of the tubal body 12, and an indentation portion 112 is provided at another end of the sealing cover 11. The sealing cover 11 utilizes the sealing rim 111 to be secured onto the tubal body 12 by adhesive or high-frequency induction hardening process. One end of the tubal body 12 adjacent to the sealing cover 11 is provided with a containment space 121 and a controller 122 is provided at another end. A stepped region 123 is formed between the containment space 121 and the controller 122. The controller 122 has at least one protrusion 124 at an inner wall. The bottom body 13 has a hollow portion 131 and a conductive sheet 132 extending from the hollow portion 131 towards to an open end. The bottom body 13 further has at least one positioning slot 14 corresponding to the protrusion 124 at an outer wall of the open end of the hollow portion 131. When the positioning slot 14 of the bottom body 13 is aligned with the protrusion 124, the conductive sheet 132 of the bottom body 13 is capable of being inserted into the controller 122 of the tubal body 12 to form a secure connection. An indication arrow 134 is provided on an outer surface of the bottom body 13 and is aligned with a position of the conductive sheet 132, which can provide indication for the position of the conductive sheet 132. The tubal body 12 has a circular slot 133 at one side of the positioning slot 14 and a sealing washer 15 provided in the circular slot 14, such that the sealing washer 15 is sandwiched between the tubal body 12 and the bottom body 13 to provide a water-proof effect. A driving motor 20 is mounted in the containment space 121 of the tubal body 12 and securely sandwiched by the sealing rim 111 of the sealing cover 11 and the stepped region 123 of the tubal body 12. The driving motor 20 is provided with a rotating shaft 21 which is disposed in the sealing cover 11 and combined with an eccentric block 22. Therefore, the rotating shaft 21 of the driving motor 20 is capable of driving the eccentric block 22 to generate rotation and vibration in the sealing cover 11. The driving motor 20 further is provided with a first conductive part 23 and a second conductive part 24 formed towards to the controller 122, and the first conductive part 23 of the driving motor 20 is capable of making contact with the conductive sheet 132 of the bottom body 13. A power supply element 30 is mounted in the hollow portion 131 of the bottom body 13. The power supply element is provided with a first electrode 31 and a second electrode 32, the first electrode 31 makes contact with the second conductive part 24 of the driving motor 20, and the second electrode 32 makes contact with the conductive sheet 132 of the bottom body 13. Furthermore, the tubal body 12 is provided with a control panel 16 disposed at the outer wall of the controller 122, which controls the connection between the conductive sheet 132 of the bottom body 13 and the first conductive part 23 of the driving motor 20. Please refer to FIG. 4 and FIG. 5. The control panel 16 of the tubal body 12 provides a CLOSE/OPEN position 161, an OFF position 162 and an ON position 163. The positioning slot 14 of the bottom body 13 is an L-shaped slot and has two protruding strips 141 to be divided into a CLOSE/OPEN corresponding slot 142, an OFF corresponding slot 143 and an ON corresponding slot 144. When the conductive sheet 132 of the bottom body 13 is aligned the CLOSE/OPEN positions 161, the protrusion 124 of the tubal body 12 can be inserted into the CLOSE/OPEN corresponding slots 142 of the positioning slot 14. When the protrusion 124 is placed in the OFF corresponding slot 143, the conductive sheet 132 is aligned with the OFF position 162 of the control panel 16. When the protrusion 124 is placed in the ON corresponding slot 144, the conductive sheet 132 is aligned with the ON position 163 of the control panel 16, which makes the contact between the conductive sheet 142 and the first conductive part 23. The massaging member 40 has a bowl-like shape and a lip 41 with an elastic curved surface 411 at a circumference edge, and a connecting portion 41 is provided at an end of the massaging member 40 and disposed in the indentation portion 112 of the sealing cover 11. The indentation portion 112 of the sealing cover 11 is provided with a securing slot 113, the massaging member 40 is provided with a through aperture 421 at the connecting portion 42, and a securing pin 43 is placed through the through aperture 421 and the securing slot 113 to securely combine the massaging member 40 and the sealing cover 11. Accordingly, the casing 10 is disposed perpendicular with the lip 41 of the massaging member 40.

For actual assembly, please refer to FIGS. 1, 2, and 3 again. The casing 10 is completed by assembling the sealing cover 11, the tubal body 12 and the bottom body 13 together. The driving motor 20 is mounted in the containment space 121 of the tubal body 12, and the first conductive part 23 and the second conductive part 24 of the driving motor 20 are accepted in the controller 122 of the tubal body 12. The driving motor 20 further has the eccentric block 22 at one end of the rotating shaft 21, and the sealing cover 11 covers the eccentric block 22 of the driving motor 20. The driving motor 20 is securely sandwiched by the sealing rim 111 of the sealing cover 11 and the stepped region 123 of the tubal body 12. The sealing cover 11 utilizes the sealing rim 111 to be secured onto the tubal body 12 by adhesive or high-frequency induction hardening process, such that a water-proof effect is provided between the sealing cover 11 and the tubal body 12. The second electrode 32 of the power supply element 30 is placed in the hollow portion 131 of the bottom body 13 to make contact between the second electrode 32 and the conductive sheet 132. The sealing washer 15 is provided in the circular slot 133 of the bottom body 13. When the bottom body 13 needs to be assembled onto the tubal body 12, the positioning slot 14 of the bottom body 13 is aligned with the protrusion 124 of the tubal body 12 to form engagement. Therefore, when the bottom body 13 is rotated to engage the protrusion 124 with the positioning slot 14, the first electrode 31 of the power supply element 30 makes contact with the second conductive part 24 of the driving motor 20, which assembles the casing 10, the driving motor 20 and the power supply element 30 together. Furthermore, the massaging member 40 utilizes the connecting portion 42 to engage with the indentation portion 112 of the sealing cover 11, and the securing pin 43 is placed through the through aperture 421 of the connecting portion 42 and the securing slot 113 of the sealing cover 11 to complete the assembly.

Figure 4:
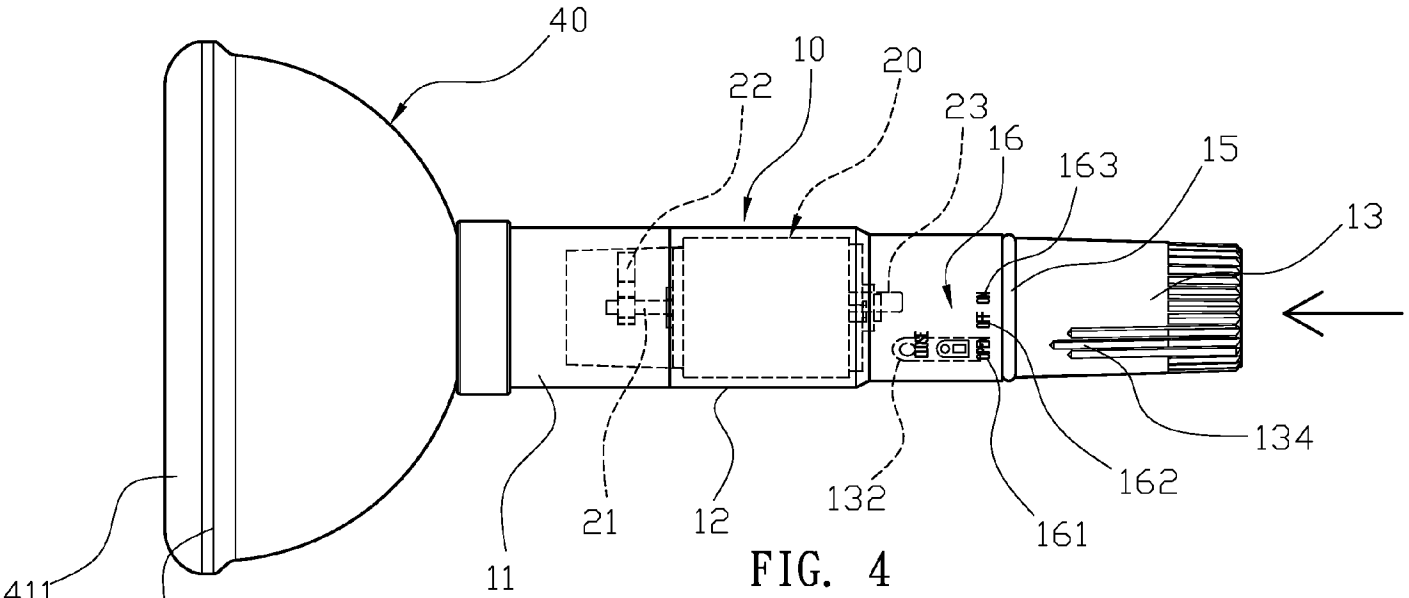
FIG. 4 is a schematic drawing showing a CLOSE position and an OPEN position according to the embodiment of the present invention.
Figure 5:
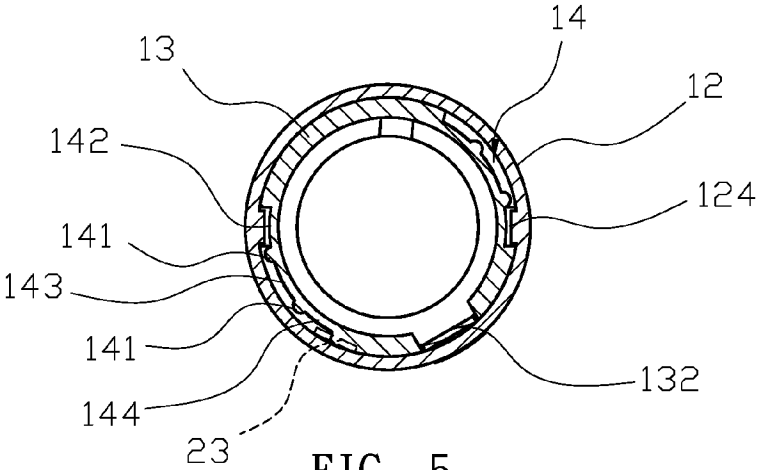
FIG. 5 is a cross-sectional drawing showing the CLOSE position and the OPEN position according to the embodiment of the present invention.
Figure 6:
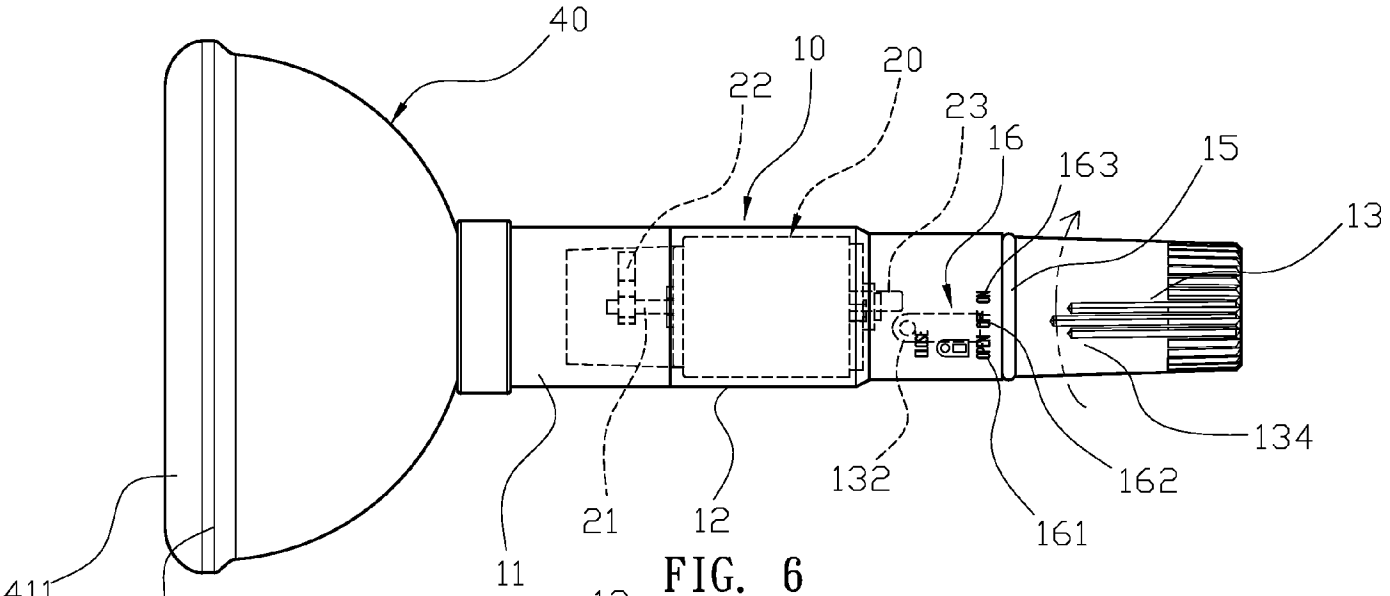
FIG. 6 is a schematic drawing showing an OFF position according to the embodiment of the present invention.
Figure 7:
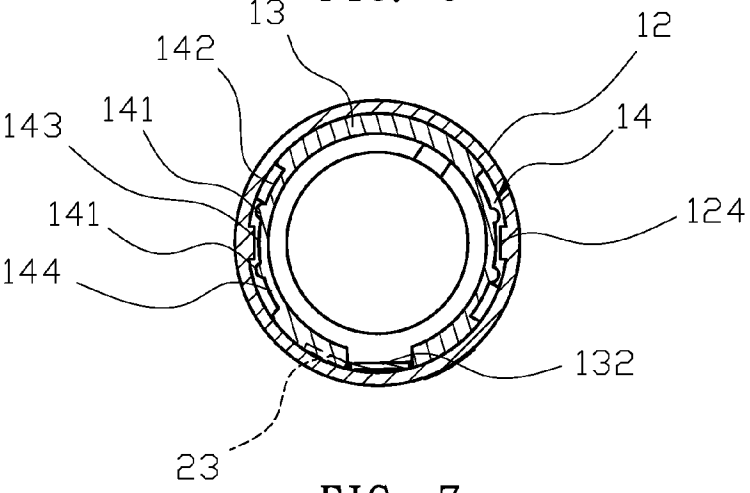
FIG. 7 is a cross-sectional drawing showing the OFF position according to the embodiment of the present invention.
Figure 8:
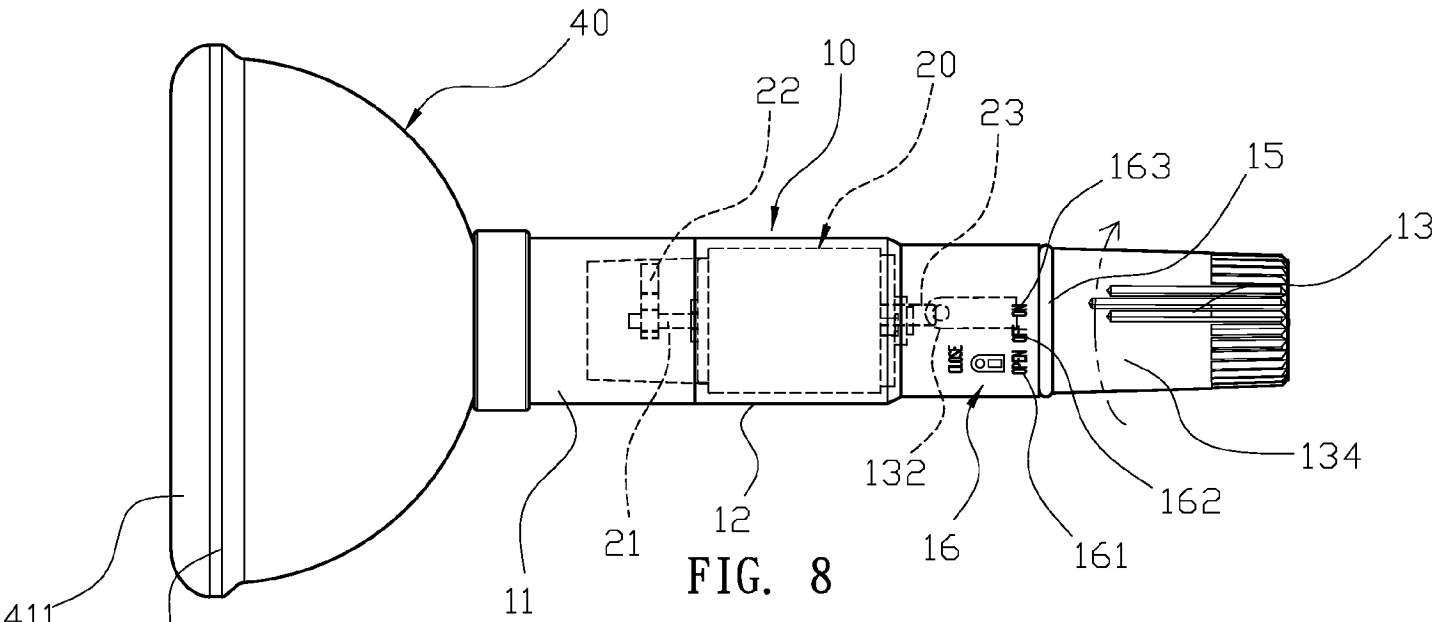
FIG. 8 is a schematic drawing showing an ON position according to the embodiment of the present invention.
Figure 9:
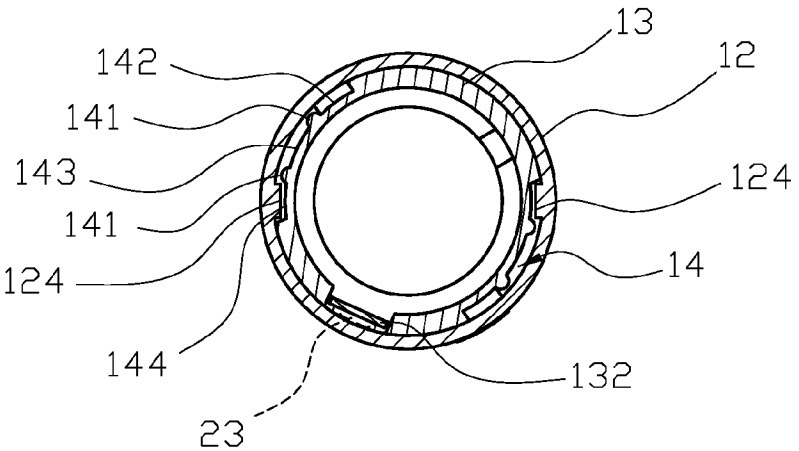
FIG. 9 is a cross-sectional drawing showing the ON position according to the embodiment of the present invention.

For operation of the embodiment of the present invention, please refer to FIG. 4 and FIG. 5 with FIG. 2. When the bottom body 13 needs to be assembled onto the tubal body 12, the user can easily see to align the conductive sheet 132 of the bottom body 13 with the CLOSE/OPEN position 161 of the control panel 16 on the tubal body 12, to align the CLOSE/OPEN corresponding slot 142 of the positioning slot 14 with the protrusion 124. Please refer to FIG. 6 and FIG. 7. With the indication from the control panel 16, when the bottom body 13 is inserted into the tubal body 12, the user can rotate the bottom body 13 to make the indication arrow 134 to move to the OFF position 162 such that the protrusion 124 of the tubal body 12 is capable of moving over the protruding strip 141 of the positioning slot 14 to be placed in the OFF corresponding slot 143 to secure the tubal body 12 and the bottom body 13 together. Please refer to FIG. 8 and FIG. 9. With the indication from the control panel 16, when the user rotates the bottom body 13 to move the indication arrow 134 to the ON position 163, the conductive sheet 132 of the bottom body 13 and the first conductive part 23 of the driving motor 20 make contact with each other, such that the second electrode 32 of the power supply element 30 is electrically connected to the driving motor 20 through the conductive sheet 132, to active the driving motor 20. Therefore, the rotating shaft 21 of the driving motor 20 rotates to drive the eccentric block 22 to generate vibration. Meanwhile, the protrusion 124 is correspondingly moved to the ON corresponding slot 144 of the positioning slot 14, and the engagement between the protrusion 124 and the positioning slot 14 provides positioning effect to the driving motor 20. The engagement between the protrusion 124 of the tubal body 12 and the positioning slot 14 of the bottom body 13 provides connection and positioning, and the control panel 16 provides status indication.

Figure 10:
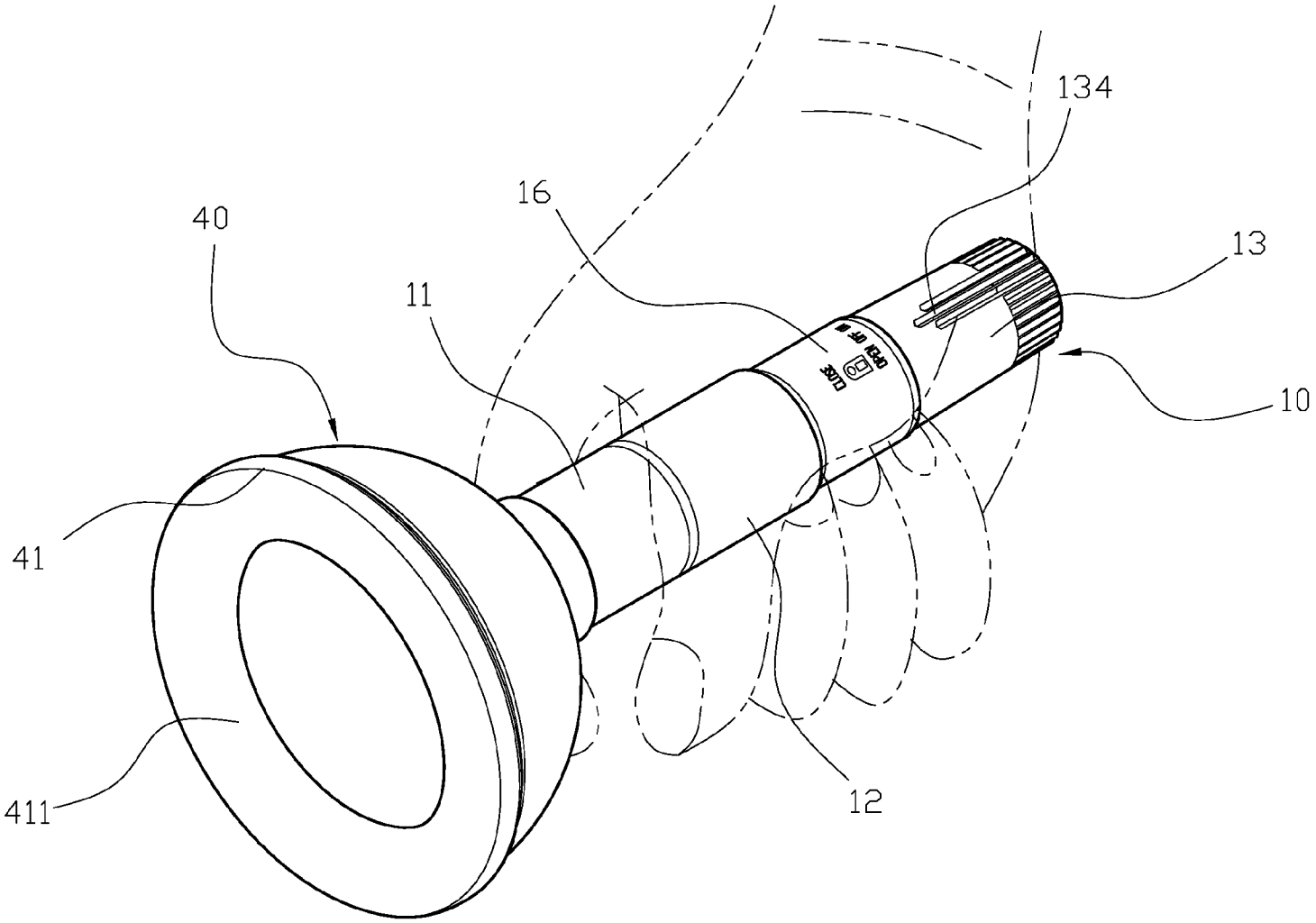
FIG. 10 is a schematic drawing shown the embodiment of the present invention being held by a user.
Figure 11:
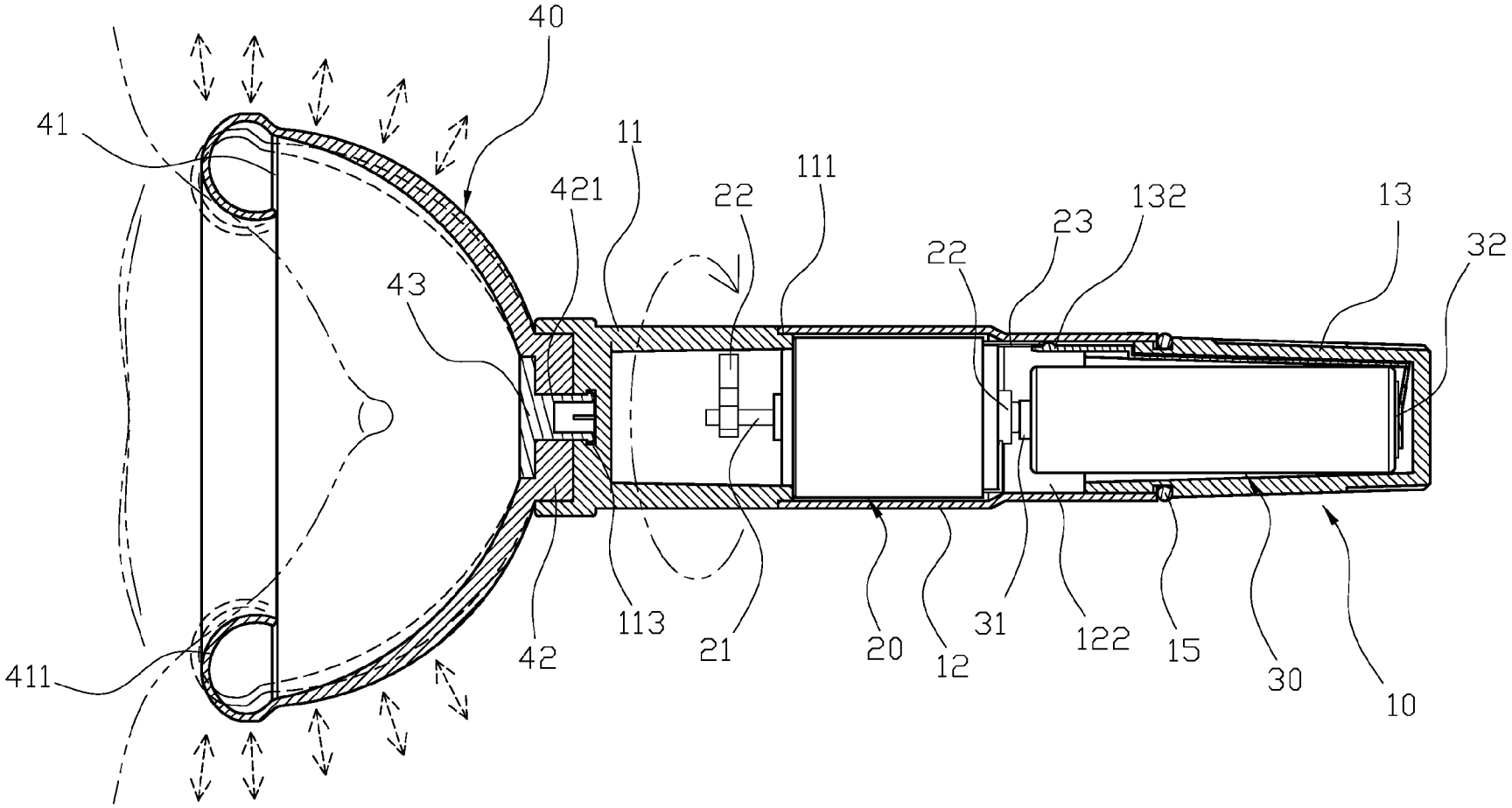
FIG. 11 is a schematic drawing showing actual operation of embodiment of the present invention.

As shown in FIG. 2 and FIG. 10, the casing 10 has a long rod shape, and the casing 10 is disposed perpendicular with the lip 41 of the massaging member 40. The casing 10 is designed in a regular hand-held size and capable of accepting the driving motor 20 and the power supply element 30, and the massaging member 40 is mounted in the sealing cover 11 of the casing 10 for providing vibration. Please refer to FIG. 11. When the user holds the casing 10 and makes the lip 41 of the massaging member 40 to make contact with the breast region, the elastic curved surface 411 of the lip 41 should be able to make large surface contact with the skin of the breast region, to avoid discomfort during massage vibration. When the driving motor 20 is active, the eccentric rotation of the eccentric block 22 generates vibration effect to the massaging member 40, which is delivered to the breast region of the user via the elastic curved surface 411 of the massaging member 40. Another characteristic of the embodiment of the present invention is water-proof effect. The water-proof effect is provided between the sealing cover 11 and the tubal body 12 by adhesive or high-frequency induction hardening process. Furthermore, the circular slot 133 of the bottom body 13 is provided with the sealing washer 15, and the tubal body 12 and the bottom body 13 sandwich the sealing washer 15 in between for a water sealing effect. Therefore, the casing 10 is capable of completely seal-in the driving motor 20 and the power supply element 30, which is very convenient for the user to use the massager in the shower or the bathtub without short circuit problems.

Although the present invention has been explained in relation to its preferred embodiment, it is to be understood that many other possible modifications and variations can be made without departing from the spirit and scope of the invention as hereinafter claimed.

What is claimed is:

1. A waterproof hand-held electric breast massager comprising:

a casing with a tubal shape having a sealing cover, a tubal body and a bottom body; the sealing cover having a sealing rim at one end and the sealing rim completely separated from one end of the tubal body, an indentation portion provided at another end of the sealing cover; one end of the tubal body adjacent to the sealing cover provided with a containment space and a controller provided at another end, and a stepped region formed between the containment space and the controller, the controller having at least one protrusion at an inner wall; the bottom body having a hollow portion and a conductive sheet extending from the hollow portion towards to an open end; the bottom body having at least one positioning slot corresponding to the protrusion at an outer wall of the open end of the hollow portion; the tubal body having a circular slot at one side of the positioning slot and a sealing washer provided in the circular slot, such that the sealing washer is sandwiched between the tubal body and the bottom body;

a driving motor mounted in the containment space of the tubal body and securely sandwiched by the sealing cover and the stepped region of the tubal body, the driving motor provided with a rotating shaft disposed in the sealing rim and combined with an eccentric block; the driving motor further provided with a first conductive part and a second conductive part formed towards to the controller, and the first conductive part of the driving motor capable of making contact with the conductive sheet of the bottom body;

a power supply element mounted in the hollow portion of the bottom body, the power supply element provided with a first electrode and a second electrode, the first electrode making contact with the second conductive part of the driving motor, and the second electrode making contact with the conductive sheet of the bottom body;

a massaging member having a bowl-like shape and a lip with an elastic curved surface at a circumference edge, a connecting portion provided at an end of the massaging member and disposed in the indentation portion of the sealing cover such that the casing is disposed perpendicular with the lip of the massaging member.

2. The waterproof hand-held electric breast massager as claimed in claim 1, wherein the tubal body is provided with a control panel disposed at the outer wall of the controller, which controls the connection between the conductive sheet of the bottom body and the first conductive part of the driving motor.

3. The waterproof hand-held electric breast massager as claimed in claim 2, wherein the control panel of the tubal body provides a CLOSE/OPEN position, an OFF position and an ON position, the positioning slot of the bottom body is an L-shaped slot and has two protruding strips to be divided into a CLOSE/OPEN corresponding slot, an OFF corresponding slot and an ON corresponding slot; when the conductive sheet of the bottom body is aligned the CLOSE/OPEN positions, the protrusion of the tubal body can be inserted into the CLOSE and OPEN corresponding slots of the positioning slot, which controls the contact between the conductive sheet and the first conductive part.

4. The waterproof hand-held electric breast massager as claimed in claim 1, wherein the indentation portion of the sealing cover is provided with a securing slot, the massaging member is provided with a through aperture at the connecting portion, and a securing pin is placed through the through aperture and the securing slot to securely combine the massaging member and the sealing cover.

5. The waterproof hand-held electric breast massager as claimed in claim 1, wherein the sealing cover utilizes the sealing rim to be secured onto the tubal body by adhesive.

6. The waterproof hand-held electric breast massager as claimed in claim 1, wherein the sealing cover utilizes the sealing rim to be secured onto the tubal body by high-frequency induction hardening process.

7. The waterproof hand-held electric breast massager as claimed in claim 1, wherein an indication arrow is provided on an outer surface of the bottom body and is aligned with a position of the conductive sheet.

* * * * *